United States Patent [19]

Mueller et al.

[11] 4,211,181

[45] Jul. 8, 1980

[54] APPARATUS FOR APPLYING ADHESIVE TO OPPOSED SURFACES OF SHAPED MEMBERS

[75] Inventors: Achim Mueller, Herzogenrath; Hans-Dieter Peetz, Aachen; Peter Scheeren, Wuerselen; Helmut Sistig, Aachen; Andreas Schallenberg, Cologne, all of Fed. Rep. of Germany

[73] Assignee: Saint Gobain Industries, Neuilly-sur-Seine, France

[21] Appl. No.: 816,163

[22] Filed: Jul. 15, 1977

[30] Foreign Application Priority Data

Jul. 17, 1976 [DE] Fed. Rep. of Germany ..... 2632337

[51] Int. Cl.[2] ..... B05C 5/02

[52] U.S. Cl. ..... 118/411; 118/421

[58] Field of Search ..... 118/411, 421, 412, 316, 118/DIG. 9; 156/578; 427/286, 356, 358

[56] References Cited

U.S. PATENT DOCUMENTS

| | | | |
|---|---|---|---|
| 778,709 | 12/1904 | Robertson | 118/DIG. 9 |
| 2,050,295 | 8/1936 | Edwards | 118/DIG. 9 |
| 2,237,357 | 4/1941 | Milner | 101/328 X |
| 2,360,918 | 10/1944 | Wade | 118/DIG. 9 |
| 3,362,379 | 1/1968 | Knudtson | 118/411 X |
| 3,424,836 | 1/1969 | McKelvey et al. | 118/411 X |

*Primary Examiner*—John P. McIntosh
*Attorney, Agent, or Firm*—Pennie & Edmonds

[57] ABSTRACT

An apparatus is disclosed which simultaneously coats opposed lateral faces of shaped parts with an adhesive material. Such apparatus comprises conveying means for advancing the shaped part in an upright position along a predetermined path. First means are embodied for purposes of pressing the shaped part into firm engagement with the conveying means. A pair of spaced apart extrusion nozzles is envisioned with each one having a port laterally aligned to the other and being disposed on opposite sides of the advancing shaped part for applying adhesive material to each of the corresponding lateral faces of such shaped part. This apparatus envisions that the first means at least guides and maintains the shaped part in a centered position such that it can pass between the two extrusion nozzles. The first means serves to press the shaped part in a direction perpendicular to a line between the aligned extrusion nozzle ports.

5 Claims, 3 Drawing Figures

Fig. 2
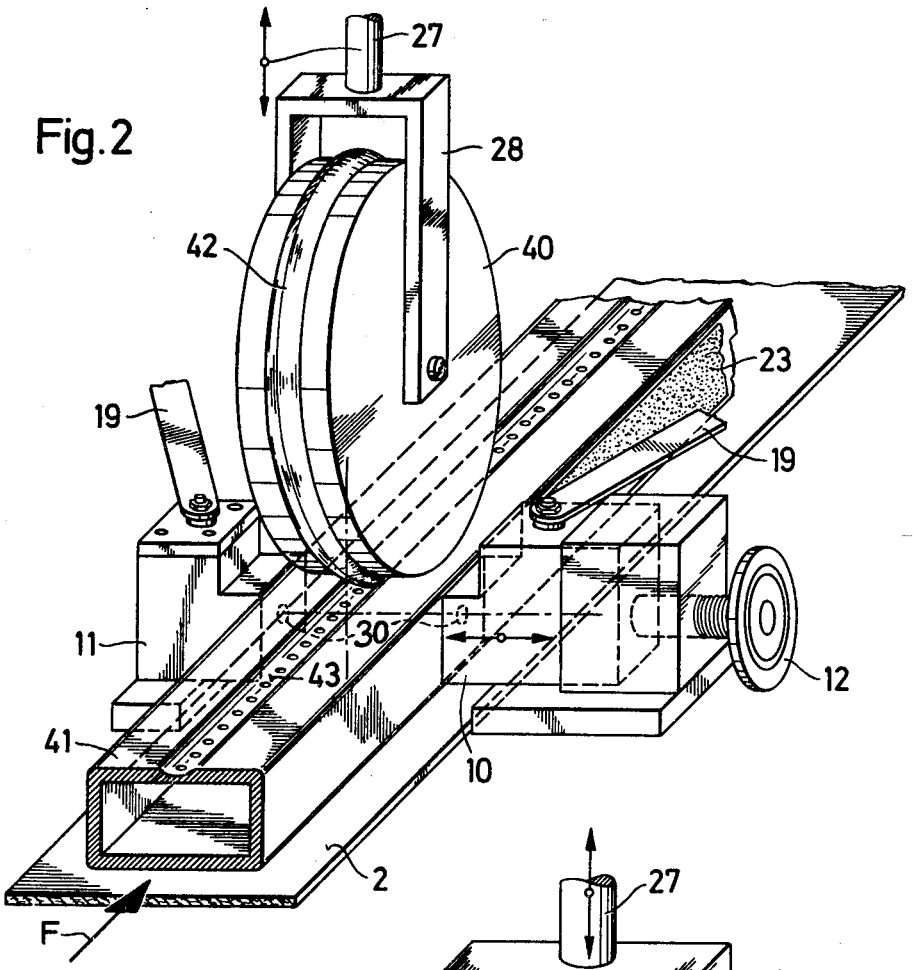
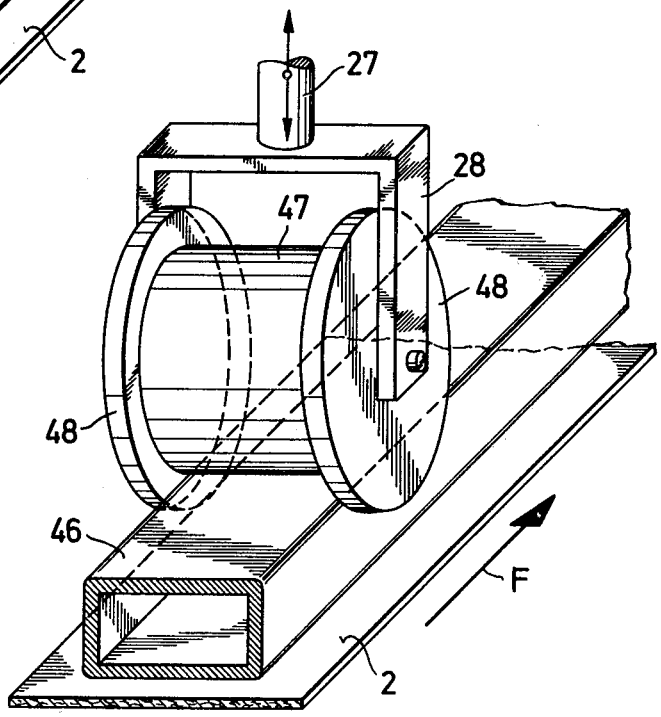
Fig. 3

APPARATUS FOR APPLYING ADHESIVE TO OPPOSED SURFACES OF SHAPED MEMBERS

BACKGROUND OF THE INVENTION

1. Field of the Invention

In general, this invention relates to an improved apparatus for simultaneously applying adhesive to lateral faces of a shaped part which is designed to constitute a frame that is interposed between two glass sheets of an insulating glass window.

2. Brief Description of the Prior Art

Heretofore known in the field of applying adhesive to frame members for use in formation of glass windows, there are devices which, in general, comprise a conveyor belt that transports upright placed shaped parts between two extrusion nozzles located opposite each other, a pressing roller which downwardly presses the shaped part against the conveyor belt.

In the prior art, the types of shaped parts which are to be coated and which generally constitute the intercalated units of insulating glass windows have a practically rectangular section. The frames formed by the assembly of such shaped parts are typically coated on the bottom sides which are designed to receive the glass sheets with an appropriate glue, for example, synthetic rubber known as BUTYL. The frames are then suitably joined to the corresponding glass sheets and the thus assembled unit is pressed to complete the entire assembly. In order to improve the tightness still further, the edges of the sheet may be allowed to project onto the intercalated unit and the groove thus created is then filled with an auxiliary layer of mastic.

The contemporary glues used to effect the deposits on the sides of the shaped parts are typically highly viscous masses which upon pressing of the assembly must not run over outside the shaped part towards the inside of the intermediate space filled with air. Furthermore, the joints thus obtained must be free of air pockets. It is for this reason that a deposit of glue onto the shaped part must be effected as a relatively thin, highly regular and bubble-free layer. Accordingly, the design and operation of the above-mentioned machines are subjected to very stringent requirements.

In presently known machines, the raisable pressing roller which presses the shaped parts is arranged at a certain distance in front of the nozzles. Such machines work satisfactorily for the coating of rectilinear shaped parts comprised of frame members with sharp right angles designed for flat insulating glass windows. Difficulties, however, arise with this category of machines whenever it is necessary to produce insulating glass windows with rounded corners. Furthermore, convex, cylindrical or even spherical insulating glass windows require a double bending of the intercalated units. Thus, applying a layer of glue of uniform thickness runs into considerable difficulties and heretofore known machines do not obtain it. Insulating glass windows which employ the latter type of non-rectilinear frames are found mainly on vehicles and, in particular, the lateral windows of motor coaches.

Also, the pressing rollers generally employed in connection with the foregoing described apparatus are not as successful in laterally guiding the shaped parts as is otherwise desirable and, in particular, shaped parts having a groove formed with aeration holes.

SUMMARY OF THE INVENTION

The object of the present invention is to improve the above-mentioned devices so as to enable them to coat rounded or bent intercalated units and, more particularly, to coat those intercalated units designed for convex, cylindrical or even spherical insulating glass windows.

Broadly, in accordance with the spirit and scope of this invention, there is disclosed an improved apparatus which simultaneously coats opposed lateral faces of shaped parts with an adhesive material. Such apparatus comprises conveying means for advancing the shaped part in an upright position along a predetermined path. The invention embodies first means for purposes of pressing the shaped part into firm engagement with the conveying means. Envisioned is a pair of spaced apart extrusion nozzles each having ports aligned to the other and being disposed on opposite sides of the advancing shaped part for applying adhesive material to each of the corresponding lateral faces of such shaped part. This apparatus envisions that the first means at least guides and maintains the shaped part in a centered position such that it can pass between the two extrusion nozzles. The first means serves to press the shaped part in a direction perpendicular to a line between the aligned ports of the extrusion nozzles.

In one embodiment, the first means includes lateral guiding means which is comprised of guiding rollers bearing on the opposite sides of the shaped part immediately in front of the extrusion nozzles so as to force such shaped part to a centered position so that it can pass between two extrusion nozzles. Also, the first means includes a pressing roller to press the shaped part.

According to another embodiment, the lateral guiding of the first means is provided directly by a pressing roller having relief components. Thus, for example, the pressing roller can have cylindrical shoulders with a diameter greater than that of the pressing span, and placed at a distance apart corresponding to the width of the shaped part and which can thus frame the latter.

Another embodiment envisions that whenever shaped parts are to be coated which have a groove on the internal face of the frame, in particular, a groove carrying aerations holes, which today is the case for a large number of currently shaped parts, the pressing roller can be provided with projecting components having a shape corresponding to the section of the groove and placed in the middle of its span.

BRIEF DESCRIPTION OF THE DRAWINGS

The invention will now be described in greater detail with reference to the accompanying drawings.

FIG. 2 is an enlarged fragmented view of another embodiment of the present invention;

FIG. 3 is an enlarged fragmented view of a third embodiment made in accordance with the principles of the present invention.

DETAILED DESCRIPTION

Figure 1:
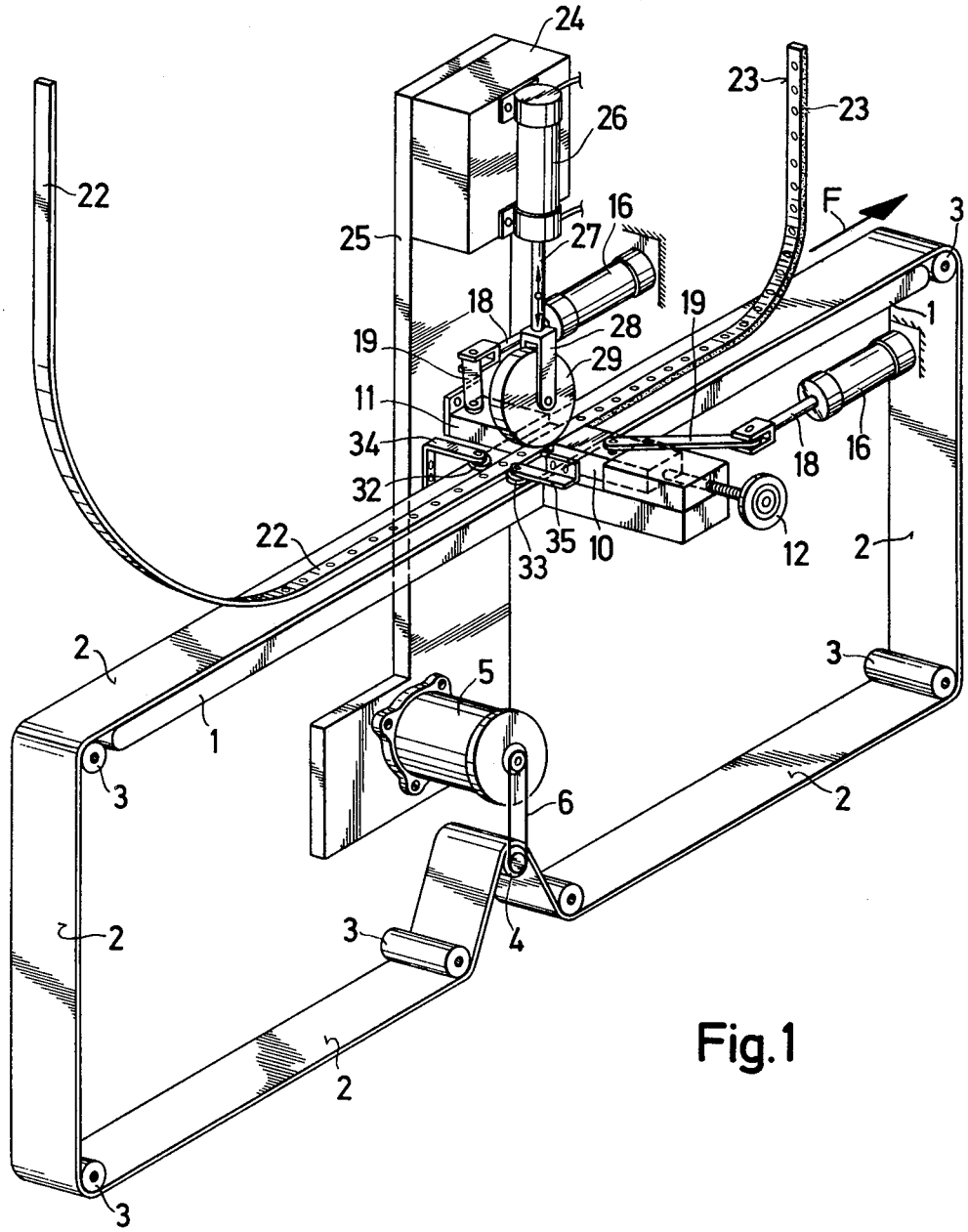
FIG. 1 is a perspective schematic view of a first embodiment of an apparatus made according to the present invention.

The main components of a coating machine of the type considered comprises a rigid table 1 supporting a conveyor belt 2 rolled around rollers 3 and driven by a roller 4 connected to a motor 5 by a gearing chain 6 or equivalent power transmitting device. All these components are mounted onto a frame of the machine which is not shown and not forming a part of the invention.

The conveyor belt 2 moves in the direction of arrow F; above the latter and at the site of the coating station itself are two conventional injection nozzles 10 and 11 shown here in schematic form. Nozzle 11 is connected with the frame of the machine. The distance between nozzles 10 and 11 can be set using a known type of manual screw control device or handwheel generally represented by reference numeral 12 and operatively connected to nozzle 10. In this fashion, it is possible to pass shaped parts of different widths between such nozzles 10 and 11.

To control the nozzles 10 and 11, that is to open them and close them so as to regulate dispensing of adhesive at the beginning and at the end of the coating process, there are provided two jacks 16 which simultaneously control their opening through a piston rod 18 connected to a lever 19. In a known manner and in response to jacks 16, the nozzles 10 and 11 deliver a thin strip of adhesive material on either side of shaped part 22, which adheres to the latter's sides thus forming corresponding ribbons of glue 23; one of which is shown. On a column 25, which is also integrally connected in known manner with the frame of the machine, there is mounted a bracket 24 bearing a vertical jack 26 the rod of which 27 ends with a fork 28 carrying a pressing roller 29. The pressing roller 29 is, preferably, placed exactly above the middle of an imaginary line joining the ports 30 of the two nozzles 10 and 11.

The bent or formed intercalated frame member or shaped part 22 is placed on the conveyor belt 2 while pressing roller 29 is in a high position, and then the jack 26 lowers roller 29 into the shaped part 22 so as to press downwardly to and between the nozzles 10 and 11. The start-up of motor 5 causes forward motion of the shaped part 22 thereon and the control of the two jacks 16, in a known manner, makes it possible for the coating process to begin.

Two lateral guiding rollers 32 and 33 are placed in front of nozzles 10 and 11. Roller 32 is directly on a support 34 integral with the frame of the machine and roller 33 on a support 35 mounted on the body of nozzle 10 so as to be associated with it in its motion. The two guiding rollers 32, 33 are placed as close as the design will permit to the plane determined by the axis of rod 27 and the line connecting the ports or openings 30 of the nozzles 10 and 11. The guiding rollers 32 and 33 bear on the sides of the moving shaped part 22 providing for its centering and for the constancy of the thickness under which glue 23 is evenly applied.

Accordingly, the coating device is provided, in the immediate vicinity of the extrusion nozzles 10 and 11, with lateral guiding member 32 and 33 forcing the lateral faces of the shaped part 22 to be coated to take up a position at the same distance from the two extrusion nozzles. The pressing roller 29 is placed just perpendicularly to the line connecting the nozzle's ports.

For reasons of simplicity, the shaped part 22 is shown in a perspective view as a simple frame component. The specific advantage of the machine lies, however, in the fact, as indicated above, that it is possible not only to coat closed frames, but also frames having a complicated shape without jeopardizing its continuously smooth operation.

In the embodiment shown in FIG. 2, the pressing roller 40 has not only the function of pressing shaped part 41 against conveyor belt 2, but also guides it longitudinally so that the lateral guiding rollers of the earlier described embodiment can be eliminated.

To this end, the pressing roller 40 has on its periphery a bearing surface provided with a guiding rib 42, the shape of which corresponds to that of groove 43 formed on the upper face of shaped part 41. Such groove is formed with aeration holes. As far as the rest is concerned, the machine corresponds generally to that represented in FIG. 1.

FIG. 3 shows another embodiment which is more particularly designed for shaped part 46 of the configuration shown which is free of grooves. In this embodiment, however, pressing roller 47 has two lateral shoulders 48, the diameters of which are a little larger than that of the pressing face situated therebetween. These shoulders 48 encompass shaped part 46 and guide and maintain it laterally so as to keep such port centered between the nozzles. Likewise, the lateral guiding rollers 32 are not needed. The nozzles 10 and 11 are arranged so as to avoid contacting the lateral shoulders.

The invention, therefore, is based on the basic idea which entails guiding the shaped part in a precise manner in the two directions perpendicular to the conveying direction, while, as much as possible, bringing closer the spans of the guiding devices to the plane perpendicular to the conveying plane passing through the centers of the ports of both nozzles. As a result, during the operation, the pressing rollers and conveying belt 2 bear exactly above and below the line connecting the ports 30 of the nozzles 10 and 11 so that it is no longer necessary to have the frame rest on a greater length and such frame can, therefore, have rounded corners to the extent that the radius of curvature is not smaller than that of the pressing roller. Furthermore, the guiding in the horizontal direction guarantees that at the time of coating, the lateral spacing with respect to the extrusion nozzles 10 and 11 will always be the same regardless of the frame having convex, cylindrically, or spherically curved shapes without being decentered with respect to the nozzles during conveyance between the latter.

While the invention has been described in connection with the preferred embodiments, it is not intended to limit the invention to the particular forms set forth above, but, on the contrary, it is intended to cover such alternatives, modifications, and equivalents as may be included within the spirit and scope of the invention as defined by the appended claims.

What is claimed is:

1. An apparatus for simultaneously coating opposed lateral faces of a curved part with an adhesive material as the curved part travels along a predetermined curved path lying in a vertical plane, said adhesive material being applied at a lower run portion of the curved path, comprising:

(a) conveying means for advancing the curved part through the curved path, said path having a predetermined approximately straight section along the lower run of the path;

(b) a pair of spaced apart extrusion nozzles located along the approximately straight section of said path, each nozzle having a port laterally aligned to the other and being disposed on opposite lateral sides of the advancing curved part for applying adhesive material to each of the corresponding lateral faces of the curved part;

(c) means for setting the lateral spacing between the portions of the extrusion nozzles to a spacing complementary to the lateral width of the curved part;

(d) pressing means for pressing the curved part independently of the nozzles in a direction perpendicular to a line extending between the extrusion nozzle ports and into firm engagement with said conveying means when disposed along the straight section of said path; and (e) lateral guiding means for maintaining the curved part in a centered position between said extrusion nozzles independently of the nozzles as the part passes therebetween, said guiding means being located only immediately adjacent the point of application of said adhesive material and being the sole lateral guiding means along said path so as to leave the curved part free of said guiding means along substantially most of the curved path.

2. An apparatus as set forth in claim 1 wherein said lateral guiding means comprises two rollers bearing on the lateral faces immediately upstream of said spaced apart extrusion nozzles.

3. An apparatus as set forth in claim 1 wherein said pressing means includes a raisable pressing roller having two shoulders with a spacing larger than the pressing face of said roller, said shoulders being spaced apart by a distance equal to the lateral width of the part and engaging the lateral faces thereof and said pressing face engaging the part and pressing it against the conveying means so as to laterally guide the part.

4. An apparatus as set forth in claim 3 wherein said pressing means is located at the middle of the line connecting the ports.

5. An apparatus as set forth in claim 1 wherein:

(a) said pressing means includes a pressing roller disposed above the part for engagement therewith and pressing the part against the underlying conveying means, said pressing roller being disposed along the straight section of the path vertically above the line extending between the ports of the extrusion nozzles; and (b) said lateral guiding means comprises a projection on the peripheral surface of the pressing wheel for engaging within a complementary shaped groove formed along the surface of the part which is engaged by the pressing wheel.

* * * * *